United States Patent [19]

Neelameggham

[11] 4,280,891

[45] Jul. 28, 1981

[54] ELECTRODE ASSEMBLY FOR MELT CELL

[75] Inventor: Ramaswami Neelameggham, Salt Lake City, Utah

[73] Assignee: AMAX Magnesium Corporation, Greenwich, Conn.

[21] Appl. No.: 39,797

[22] Filed: May 17, 1979

[51] Int. Cl.[3] ..... C25C 7/02

[52] U.S. Cl. ..... 204/243 R; 13/6; 204/274; 204/288; 204/292

[58] Field of Search ..... 13/6, 18 R, 23, 25; 204/243 R, 286, 297 R, 280, 274, 288, 292

[56] References Cited

U.S. PATENT DOCUMENTS 3,489,984 1/1970 Bailey ..... 13/18 R

*Primary Examiner*—Roy N. Envall, Jr.

*Attorney, Agent, or Firm*—Malcolm L. Sutherland; Gary M. Nath

[57] ABSTRACT

An electrode assembly for use in a molten salt cell having a corrosive environment of high temperature chlorine gas and a molten bath of magnesium chloride and other salts includes a tapered metal core and is water cooled.

7 Claims, 2 Drawing Figures

ELECTRODE ASSEMBLY FOR MELT CELL

Figure 1:
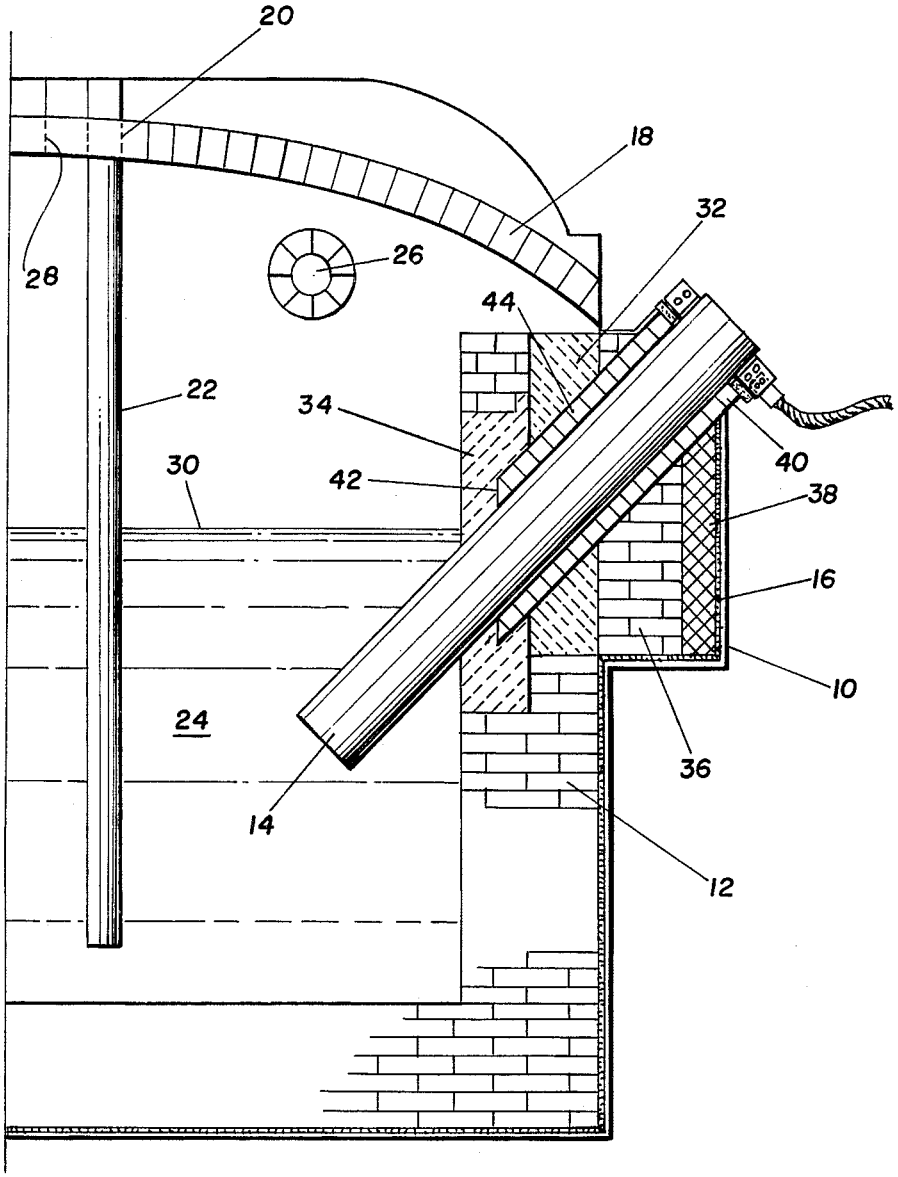

The present invention generally relates to an electrode assembly for use in corrosive atmospheres and particularly to an electrode assembly for use in melt cells employed in the molten magnesium chloride purification vessels used in the process of making magnesium by electrolysis.

Melting and chlorination of impure magnesium chloride in magnesium chloride baths kept molten by resistance heating is well known in the art. However, heretofore, among the more serious problems encountered in such production of magnesium has been the problem of applying and removing current from electrodes located within the melt cells. The electrode leads and conductors cannot withstand the corrosive atmosphere of the molten salt and chlorine gas. Further, the electrodes are required to extend into the molten salt bath and leakage commonly occurs around the electrode.

The present invention is directed to an electrode construction which solves the above mentioned problems. Heretofore, it has been proposed, see U.S. Pat. No. 3,838,384, to overcome similar problems in the production of aluminum by use of a dense, fluid impervious graphite sleeve located around a current conducting lead extending into the electrode which is mounted to extend horizontally into the melt. The sleeve extends into the body of the electrode, completely encircles the lead, and extends into the portion of the electrode contained within the melt. It has been suggested that any part of the melt bath and any gases from the cell tending to penetrate the electrode will be stopped by the impervious sleeve.

It has been found, however, that the mounting of the electrode and sleeve are subject, over a period of time, to leakage of the melt or molten bath. This is a particular problem when the refractory bricks which form the cell walls age and are attacked by the melt and the cell gases. In addition, there are rather large temperature differences between the atmosphere, to which one end of the electrode assembly is exposed, and the molten bath in which the other end of the electrode assembly is immersed and the differential expansion of the sleeve, the electrical lead and the graphite sleeve creates stress on the various joints, resulting in leaks and in many cases cracking of one or more of the electrode components.

In accordance with the present invention, the above problems are overcome through the structural features and relationships set forth below.

The inventive electrode assembly generally comprises an elongated graphite electrode having a central longitudinal axis and having one end adapted to be placed into contact with a heated material and another end having an open area extending into the graphite electrode along a path proximate to its central axis. A metal core is contained within the open area of the graphite electrode and is adapted to be connected to a source of electrical current. The metal core has a configuration which tapers from the material contact end toward the end having an open area of the electrode. The metal core is tapered sufficiently to permit controlled expansion of the core to a configuration that does not cause cracking of the graphite due to compressive forces caused by contact between the core and electrode due to expansion created by exposure of the electrode to a temperature gradient that extends along the length of the electrode due to contact with the heated material but yet contacts the graphite electrode so as to maintain good electrical contact.

During use in the melt cell, the electrode assembly is disposed at an angle to both the sidewall of the cell and the surface of the molten bath such that the electrode extends downwardly into the bath. The electrode further enters the bath at a point such that it is completely immersed in the molten bath thereby preventing the escape of gases around the electrode. The bath surface may extend several inches above the electrode if desired. The electrode assembly consists of two parts, a graphite electrode which extends through the cell wall into the bath and a metal core. The metal core is arranged within a bore or open area in the graphite electrode and is specifically designed to have a taper such that upon insertion into the bath and after the electrode and metal core reach their maximum temperatures, the metal core expands to provide a snug fit in the bore of the electrode. The graphite sleeve is surrounded by a refractory sleeve which extends into, but not through, the refractory sidewall of the cell to seal the electrode at the sidewall.

The invention, along with its advantages and objectives will be further described with reference to the accompanying drawings in which FIG. 1 is a schematic illustration of one half a melt cell utilizing an electrode assembly, in accordance with this invention, and FIG. 2 which illustrates an electrode assembly in accordance with this invention.

As indicated in FIG. 1, a melt cell utilizing an electrode in accordance with this invention is encased with shell 10 which is made of a metal such as mild steel. The lower sides and bottom of the cell are lined with acid-resistant refractory material 12. The upper portion of the cell wall around the electrode 14 is widened to accommodate additional refractory material. Between shell 10 and brick 12 along the sides of the cell is a layer of compressible material 16 such as millboard which accommodates expansion of the bricks. Roof 18 of the cell is an arched configuration of acid resistant bricks. Extending through roof 18 are lance ports 20 which accommodate graphite lances 22 which extend into molten salt bath 24 for passage of chlorine gas into the bath. Off-gas port 26 is provided in the end wall of the cell and feed port 28 is located in the cell roof.

Pairs of graphite electrodes are provided on opposite sides of the cell, only one such electrode being illustrated for the cell half shown. Graphite electrode 14 extends through the cell wall at an angle (e.g., about 45 degrees with respect to the sidewall), such that the opening made in the outer portion of the wall for electrode entry is proximate to or just above level 30 of molten salt bath 24. The electrodes are connected to a conventional alternating current electrical source (not shown). The angle can be varied from about 40 degrees to 50 degrees while maintaining level 30 proximate to or just above the opening for the electrode. The electrodes should be submerged in the bath to prevent leakage of both gases and molten salt to the shell. The immersion is also necessary to prevent oxidation of the graphite by air leakage.

The mounting for electrode 14 includes layers 32 and 34 of large refractory blocks disposed around the graphite electrode from the inside of the cell outwardly to about the vertical line of the sidewall 12. Outwardly of layers 32 and 34 is sidewall 36 which is composed of brick similar to sidewall 12, and layer 38 composed of high alumina plastic. Sidewall 36 and layer 38 extend outwardly to about the vertical line of entry of the electrodes. The refractory blocks of layers 32 and 34 may be chosen from among a variety of available acid and halogen resistant type refractories. Ceramic sleeve 40 surrounding electrode 14 extends from the top of the electrode through hole 44 in refractory block layer 36 into slot 42 in the inner refractory block layer 34. Because sleeve 40 does not extend into the molten bath 24 and also is protected by refractory block layer 34, the sleeve is not subject to the high temperature and corrosive environment of the cell.

Figure 2:
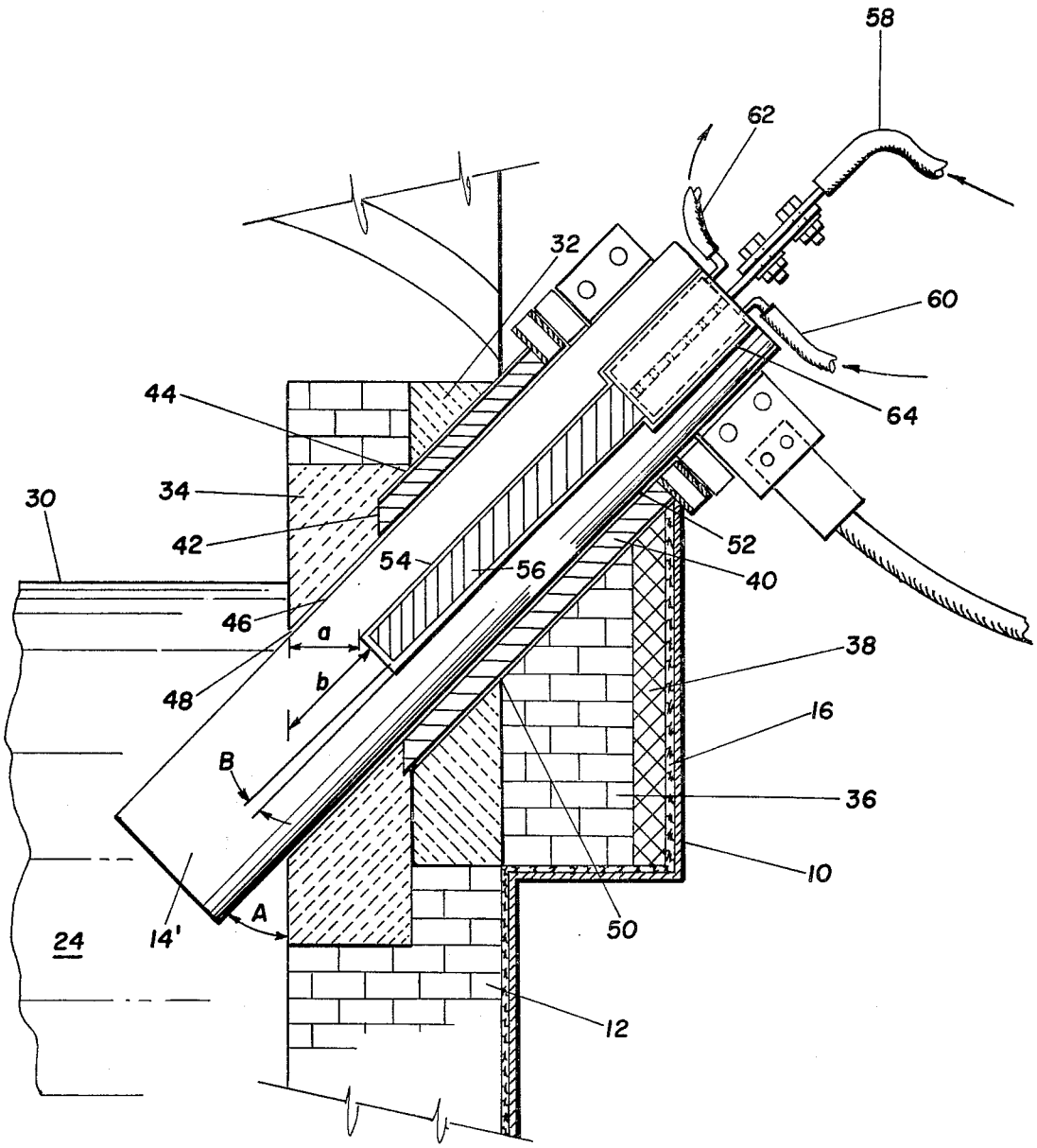

FIG. 2 illustrates electrode 14 in greater detail. As shown, graphite electrode 14 is inserted through the melt cell wall into molten bath 24 at angle A. Angle A is selected so that level 30 of bath 24 is between the innermost opening and outermost opening through which the electrode is inserted. The opening in the cell wall includes bore 44 through layer 32 and bore 46 in layer 34. Interior opening 48 of bore 46 is below level 30 of bath 24. Level 30 should be maintained to be above opening 48, typically by several inches. Level 30 should also be maintained below outer opening 52 in sleeve 40, preferably below outer opening 50 of bore 44, to avoid leakage through the sidewall. Angles of about 40 degrees to 50 degrees, preferably about 45 degrees, are suitable to avoid leakage.

Electrode 14 contains center bore 54 which extends into the electrode and houses metal core 56. Metal core 56 is connected to an electrical source, schematically illustrated by electrical cable 58 and is water cooled as illustrated by pipes 60 and 62. Bore 54 has an enlarged outer section 64 to house the water cooler. The metal core may be constructed with a metal having a higher electrical conductivity than graphite, such as nickel, copper, magnesium, aluminum, or silver. It is also within the scope of the invention to provide a nickel or like metal coating to the metal core so as to provide resistance to halogen gases and salts. The choice of a specific material is based upon its electrical resistivity and should be substantially less than that of graphite and on the order of between about 1 and 20 microohm inch. This minimizes the amount of heat generated in the composite electrode through the wall and thus serves to maintain lower electrode temperatures. The lower temperatures result in the freezing of any molten salt which has leaked through the refractory pores.

Metal core 56 is tapered along its length, as indicated by angle B. Without taper angle B, uneven expansion of core 56, due to the creation of a temperature differential along its length, would cause electrode 14 to crack during use. Angle B of the taper is selected to avoid such cracking problem and is based upon the temperature gradient along the electrode 14 and the coefficient of expansion of the particular metal core used. Typically, the bath is maintained at about 200 degrees to 250 degrees F. above the melting point of the salts forming the bath. Angle B is predetermined so that when core 56 reaches its operating temperature, it fits snugly within bore 54 to maintain good electrical contact without cracking electrode 14. An expansion of metal core 56 to a diameter of 0.2 to 0.4% greater than the diameter of bore 54 is typical and, in general, the larger or thicker the electrode and the smaller the bore, the larger the expansion of core 56 that is desirable.

In general, it has been found that an angle of taper from about 3° to 7° is satisfactory to achieve the aims of the invention.

Several electrodes constructed in accordance with this invention have been evaluated and compared with similarly arranged electrodes having no metal core. The electrodes of this invention operate at temperatures ranging from 100 degrees to 150 degrees F. cooler than electrodes without the metal core. The electrodes constructed in accordance with this invention performed satisfactorily in melt cells of magnesium chloride.

Although the present invention has been tested in the specific example cited above, the invention is also applicable for use in combination with other electrothermal and electrolytic processes that operate at high temperatures and employ electrodes that pass through insulated refractory walls.

I claim:

1. An electrolytic melt cell, comprising a refractory lined shell including refractory lined sidewalls having at least one elongated graphite electrode assembly extending into said cell through said walls at an angle of from 40° to 50° with respect thereto, said elongated graphite electrode having a central longitudinal axis, a first end adapted to be placed into contact with a material to be heated, and a second end having an open area extending into said graphite electrode along a path proximate to said central axis; and a water cooled metal core contained within said open area of said graphite electrode and adapted to be connected to a source of electrical current, said metal core having a configuration which tapers from said first end toward said second end of said electrode whereby said metal core expands due to exposure to a temperature gradient extending along said electrode created by contact with said material to be heated, said tapered metal core thereby expanding to a configuration that is sufficient to create good electrical contact between said electrode and said metal core but not sufficient to cause cracking of said graphite electrode due to compressive forces created by contact between said core and said electrode.

2. The melt cell of claim 1, wherein: said metal core and said bore are circular and said metal core expands by a factor of from 0.2% to 0.4% more than said bore on a diameter basis.

3. The melt cell of claim 1, wherein: said metal core comprises a metal having an electrical resistivity of from about 1 to 20 microohm inch.

4. The melt cell of claim 3, wherein: said metal core comprises a metal selected from the group consisting of nickel, copper, magnesium, aluminum, and silver.

5. The melt cell of claim 4, wherein: said metal core comprises nickel.

6. The melt cell of claim 1, wherein: said taper is at an angle from about 3° to 7° as measured along said central longitudinal axis.

7. The melt cell of claim 1, wherein said electrode enters the material to be heated at a point such that it is completely immersed thereby.

* * * * *